US007592533B1

(12) United States Patent
Lee

(10) Patent No.: US 7,592,533 B1
(45) Date of Patent: Sep. 22, 2009

(54) AUDIO LOOP TIMING BASED ON AUDIO EVENT INFORMATION

(76) Inventor: Gary Lee, 7018 Quito Ct., Camarillo, CA (US) 93012

( * ) Notice: Subject to any disclaimer, the term of this patent is extended or adjusted under 35 U.S.C. 154(b) by 509 days.

(21) Appl. No.: 11/336,730

(22) Filed: Jan. 20, 2006

Related U.S. Application Data

(60) Provisional application No. 60/646,208, filed on Jan. 20, 2005.

(51) Int. Cl.
*G10H 7/00* (2006.01)
*G10H 7/08* (2006.01)

(52) U.S. Cl. ..... 84/607

(58) Field of Classification Search ..... 84/603–607, 84/616

See application file for complete search history.

(56) References Cited

U.S. PATENT DOCUMENTS 4,633,748 A * 1/1987 Takashima et al. ..... 84/603
RE33,739 E * 11/1991 Takashima et al. ..... 84/603
5,478,967 A 12/1995 Saito et al.
5,973,255 A 10/1999 Tanji
6,111,182 A 8/2000 Takahashi
6,541,691 B2 * 4/2003 Tolonen et al. ..... 84/616
6,639,142 B2 * 10/2003 Takahashi ..... 84/609
6,721,711 B1 4/2004 Hoshiai
6,740,804 B2 * 5/2004 Shimizu et al. ..... 84/609
2001/0029831 A1 * 10/2001 Tsutsumi ..... 84/604
2002/0105359 A1 * 8/2002 Shimizu et al. ..... 327/1
2003/0172798 A1 9/2003 Fujiwara et al.
2004/0055444 A1 3/2004 Ishii et al.
2004/0069118 A1 * 4/2004 Okazaki et al. ..... 84/603
2004/0194613 A1 10/2004 Kusumoto
2006/0107821 A1 * 5/2006 Matsuura et al. ..... 84/603

* cited by examiner

*Primary Examiner*—Jeffrey Donels
(74) *Attorney, Agent, or Firm*—Christie, Parker & Hale, LLP

(57) ABSTRACT

An audio looping method and system that stores a segment of an audio signal and plays back the stored segment in a repeated loop. The beginning and the end of the audio segment are determined by changes in the audio signal, instead of a predetermined time interval or a time specified by manual user input. This produces a repeated loop that is timed to an event in the audio signal.

14 Claims, 4 Drawing Sheets

AUDIO LOOP TIMING BASED ON AUDIO EVENT INFORMATION

CROSS REFERENCE TO RELATED APPLICATIONS

This application claims the benefit of U.S. Provisional Application No. 60/646,208, filed on Jan. 20, 2005.

BACKGROUND OF THE INVENTION

The invention relates generally to audio methods and systems, and more particularly to audio storage and loop playback methods and systems.

A loop is an audio effect that can be used to record and repeatedly play back an audio passage during, for example, a live performance. A loop allows the performer to play additional passages along with the loop while the loop is being played back.

The type of loop effect used in real-time performances typically starts the loop at a time point specified by a user input such as the press of a footswitch or at a time aligned to a pre-programmed tempo, and ends the loop at a time point specified by a user input or at a time aligned to a pre-programmed tempo.

Because such a system times the loop starting point and the loop stopping point to a user input or pre-programmed tempo, it makes it difficult to match the audio timing to loop start and stop times. In order to achieve proper loop timing, the user must coordinate the notes or chords they are playing to their pressing of a switch or to a tempo beat playing in the background.

Consequently, at the point where the loop repeats during playback, it is difficult to get accurate musical timing, causing irregular jumps in the tempo.

SUMMARY OF THE INVENTION

Aspects of the invention allow the performer to create a loop that is timed to an audio signal, for example an audio signal generated by the performer. In some embodiments the performer produces a repeated audio loop that substantially has no musical discontinuities or tempo changes.

In accordance with aspects of the invention, a user input such as the press of a footswitch can be used to mark the next or nearest audio event that identifies the start or the end of the segment that is to be played back. The loop beginning and end is set by an audio event.

In accordance with some aspects of the invention, the user can also pre-program an audio event count. When the pre-programmed number of events is reached, the end of the segment is timed to this final event and loop playback can automatically begin.

In some aspects the invention provides an audio looping system comprising: means for designating the start of an audio segment; storage means for storing the audio segment; means for designating the end of an audio segment; and a means for repeatedly reading and outputting the stored audio segment. In some aspects the invention further provides an audio event designation means for designating the time of a note or chord played by the performer; and a means for identifying the location of the event in the stored audio data. In some embodiments the audio event comprises a change in the audio signal. In some embodiments the change is a change in time-averaged amplitude of the audio signal. In some embodiments the audio event is a change in the fundamental frequency of the audio signal. In some embodiments the audio event is when a performer first plays a note or a chord. In some aspects an audio segment comprises two or more audio events. In some aspects a first audio event identifies a beginning of the audio segment and a second audio event identifies an end of the audio segment.

In some aspects the invention provides an audio looping system comprising: means for designating the start of an audio segment; storage means for storing the segment; an event count means for designating the end of the audio segment; and a means for repeatedly reading and outputting the stored segment. In some aspects the invention further provides an audio event designation means for designating the time of a note or chord played by the performer; and a means for identifying the location of the event in the stored audio data. In some embodiments the audio event comprises a change in the audio signal. In some embodiments the change is a change in a time-averaged amplitude of the audio signal. In some embodiments the audio event is a change in the fundamental frequency of the audio signal. In some embodiments the audio event is when a performer first plays a note or a chord. In some aspects the invention further provides a means for designating the number of audio events after the first audio event as the length of the audio segment. In some aspects the location of the first audio event is identified as the beginning of the audio segment and the location of an event designated by the number of events is identified as the end of the audio segment.

In some aspects the invention provides a programmable device for applying a loop effect to an audio input signal, the device comprising a computer readable medium storing programming code for controlling the device to perform processing comprising: receiving an audio input signal; identifying an audio segment through user input; storing the audio segment from the start event location to the end event location; and repeatedly outputting the stored segment. In some aspects a first user input specifies the start of the audio segment to be the next or nearest event in the audio signal and identifies that start audio event as a location in memory of the stored segment. In some aspects the second user input specifies the end of the audio segment to be the next or nearest event in the audio signal and identifies that end audio event as a location in memory of the stored segment.

In some aspects the loop segment is repeatedly output until a user supplied stop command.

In some aspects the invention provides a programmable device for applying a loop effect to an audio input signal, the device comprising a computer readable medium storing programming code for controlling the device to perform processing comprising: receiving an audio input signal; identifying an audio segment through user input and a pre-programmed event count; storing the audio segment from the start event location to the end event location; and repeatedly outputting the stored segment. In some aspects the user input specifies the start of the audio segment to be the next or nearest event in the audio signal and identifies that start audio event as a location in memory of the stored segment. In some aspects a pre-programmed value specifies the number of events that will comprise the audio segment length and identifies the audio event number as the segment end location in memory of the stored segment. In some aspects the loop segment is repeatedly output until a user supplied stop command.

DETAILED DESCRIPTION

Figure 1:
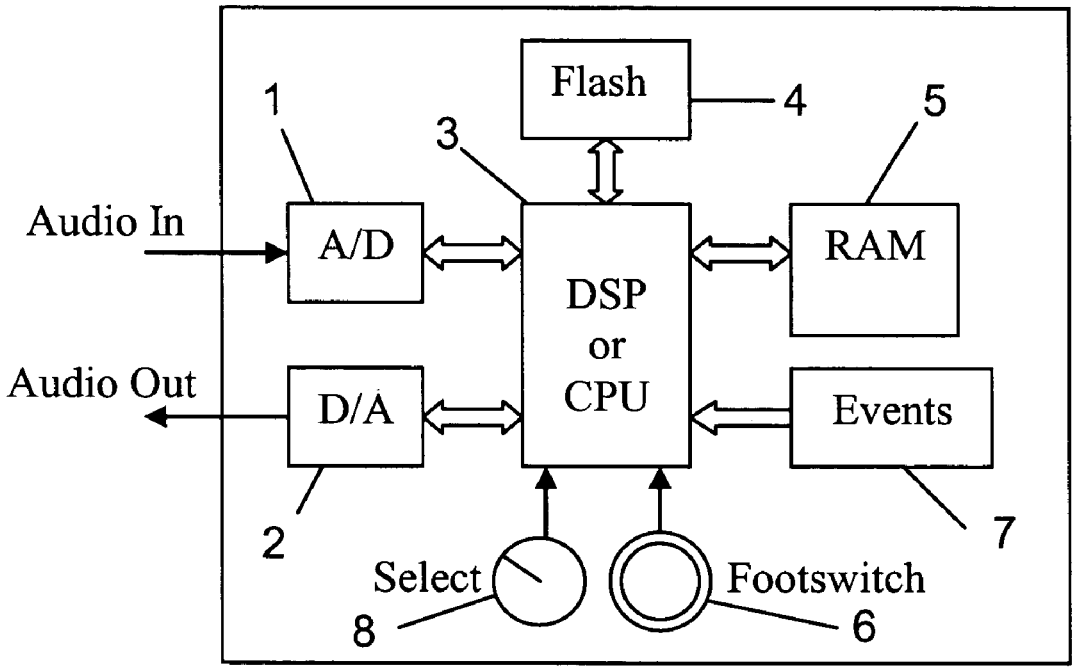
FIG. 1 is a block diagram showing a preferred embodiment of the invention.

A preferred embodiment of this invention shown in FIG. 1 is an electronic circuit that contains an analog to digital converter (A/D) 1, a digital to analog converter (D/A) 2, a digital signal processing (DSP) device or CPU 3, flash memory 4, RAM 5, a means for a user to input a control signal to the DSP 6, a means for the user to input an event count to the DSP 7 and a control selector knob to select the processing mode 8.

Figure 4:
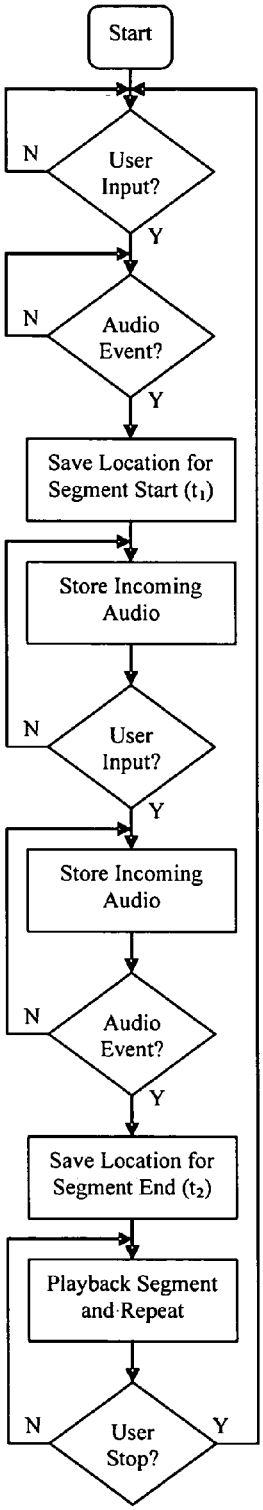
FIG. 4 is a flow chart of processing executed in accordance with the embodiment of the invention wherein a user input identifies the first event and the last event of the audio segment.
Figure 5:
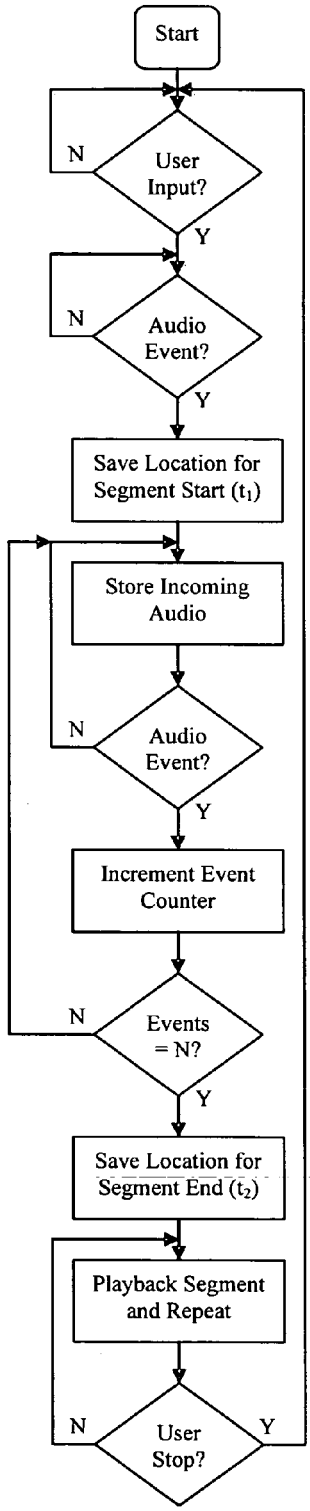
FIG. 5 is a flow chart of processing executed in accordance with the embodiment of the invention wherein the user input identifies the first event and a pre-programmed event count (N) identifies the last event of the audio segment.

An input analog audio signal is converted to digital form by the A/D and then used by the DSP, which executes one of the processes shown in FIG. 4 and FIG. 5. The processed digital output of the DSP is input to the D/A, which converts the signal back into an analog audio output.

The flash memory contains the program code that is used by the DSP to execute one of the processes shown in FIG. 4 and FIG. 5.

The RAM is used to store the digital audio data from the DSP from the beginning to the end of the audio segment, which contains the loop to be played back. Once loop playback begins, the digital audio is read from the RAM into the DSP for output through the D/A. The DSP stores the RAM address of the first audio event and the last audio event that make up the audio loop segment.

The preferred embodiment contains a means for the user to input a signal, such as a footswitch, that tells the DSP to use the next or nearest audio event as the start or end of the loop segment. There is also a means, such as a control selector knob, for selecting between one of the two processes shown in FIG. 4 and FIG. 5. There is also a means such as a control knob for inputting an event count, which is used by the process shown in FIG. 5.

Figure 2:
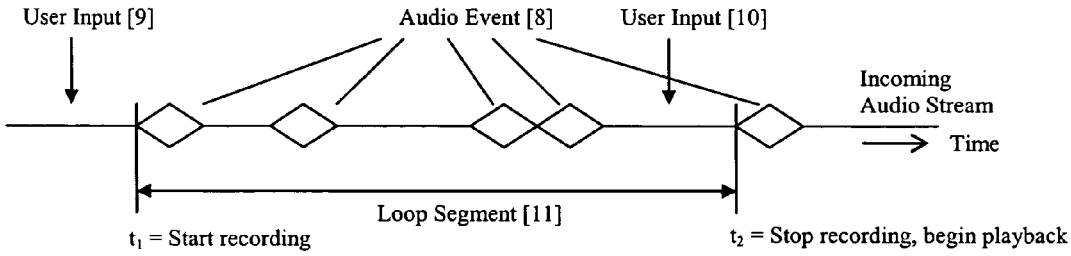
FIG. 2 shows an audio input stream and processing associated with the flow chart in FIG. 4.

FIG. 4 is a flow chart that shows a first mode of processing executed in an electronic music effects system in accordance with aspects of the invention. FIG. 2 shows an abstract view of an example audio waveform. The audio waveform is comprised of audio data. There are several audio events 8 that identified in the audio data. The audio events can be identified by a change in the time-averaged audio amplitude or a change in the fundamental audio frequency. The user input 9, 10 can come from the press of the footswitch shown in FIG. 1. After the first user input 9, the processing waits for the first audio event after this user input, and identifies the RAM address of the first audio event as the start of the loop segment ($t_1$). It then stores incoming audio data in RAM and waits for a second user input 10. When the second user input happens, it continues to store incoming audio data into RAM until the next audio event is identified and uses the second event RAM address as the end of the loop segment ($t_2$) The loop segment 11 is then played back in a repeated loop until a user stop command.

Figure 3:
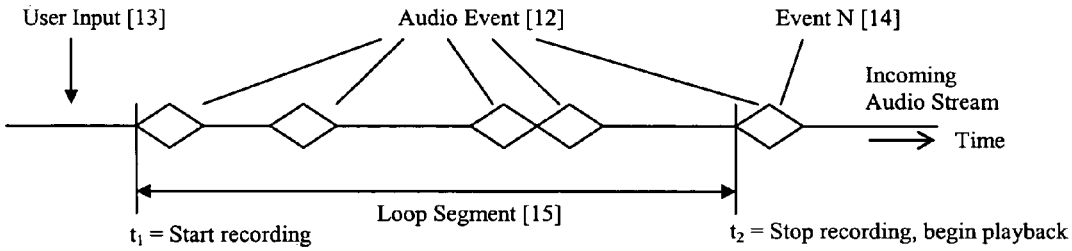
FIG. 3 shows an audio input stream and processing associated with the flow chart in FIG. 5.

FIG. 5 is a flow chart that shows a second mode of processing executed in an electronic music effects system in accordance with aspects of the invention. FIG. 3 shows an abstract view of an example audio waveform. The audio waveform is comprised of audio data. There are several audio events 12 that identified in the incoming audio data. The audio events can be identified by a change in the time-averaged audio amplitude or a change in the fundamental audio frequency. The user input 13 can come from the press of the footswitch shown in FIG. 1. After the user input 13, the processing waits for the first audio event after this user input, and identifies the RAM address of the first audio event as the start of the loop segment ($t_1$). It then stores incoming audio data in RAM and waits for the next audio event. When a new audio event is identified, it increments an event counter. If the number of events is equal to the pre-programmed value N 14, this event's RAM address is used as the end of the loop segment ($t_2$). The loop segment 15 is then played back in a repeated loop until a user stop command.

In some embodiments the DSP (or CPU) or other circuitry time-averages the amplitude of the incoming digital stream. A representation of the amplitude envelope is maintained by the DSP. Thus, the digital samples can be time-averaged to create an amplitude envelope as approximated in FIG. 6. An audio event can be identified as the time the change in the time-averaged amplitude is larger than a given value. Similarly, the DSP or other circuitry in some embodiments converts time domain information of the incoming digital stream to the frequency domain. This may be accomplished, for example, using a Fast Fourier Transform (FFT) block. An audio event can be identified as the time the change in fundamental frequency is larger than a given value. Thus, the digital time domain information can also be converted to the frequency domain in order to identify an event as a change in the fundamental frequency at a given time.

Figure 6:
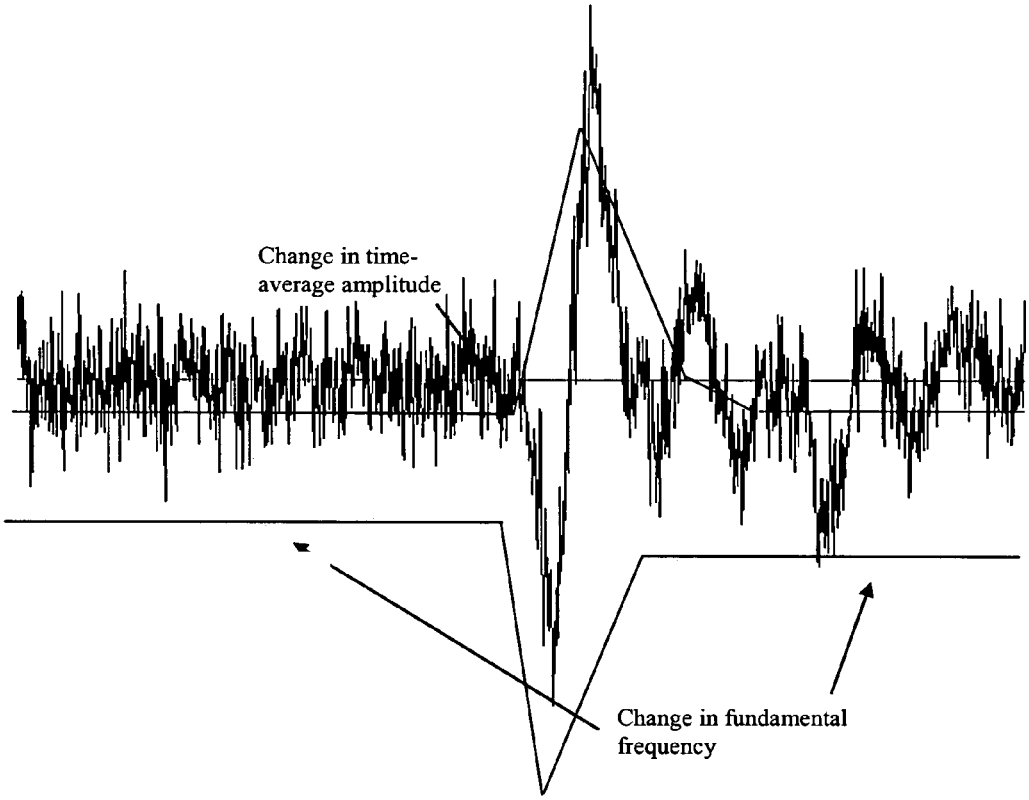
FIG. 6 shows an example digital audio waveform containing a single audio event.

FIG. 6 shows an example digital audio waveform containing a single audio event. In the example of FIG. 6, both a change in audio amplitude and a change in fundamental frequency occurs with the audio event. Accordingly, the audio event can be identified by the change in audio amplitude or the change in the fundamental frequency.

In various embodiments the invention includes a means for the incoming audio data to be looped back to the audio output during the segment acquisition. This allows the performer to hear what they are playing during the time when the audio data is being stored into memory. In various embodiments the invention includes a means for the incoming audio data to be mixed with the loop data during audio segment playback. This allows the performer to hear what they are playing during the time when the audio loop segment is being repeatedly read from memory. The audio can be optionally input, stored and played back as a mono signal or as a stereo signal. During audio segment playback, additional audio input data can be added to the loop to create multiple audio layers during subsequent loop playback. During playback, the loop can optionally end after a pre-programmed number of playback times. During playback, the loop can optionally fade out after a pre-programmed number of playback times.

The invention provides audio storage and loop playback methods and systems. Although the invention has been described with respect to certain aspects, it should be recognized that the invention comprises the claims and their insubstantial variations supported by the disclosure.

The invention claimed is:

1. An audio looping system comprising:

means for detecting a specific audio event in an audio signal;

means for designating a start of an audio segment of the audio signal in response to detection of the specific audio event;

means for detecting another occurrence of the specific audio event;

means for designating an end of the audio segment in response to detection of the another occurrence of the specific audio event;

means for storing the audio segment; and means for repeatedly reading and outputting the stored audio segment.

2. The audio looping system of claim 1, wherein the start of the audio segment corresponds to a specific reference location of the specific audio event, and the end of the audio segment corresponds to the specific reference location of the another occurrence of the specific audio event.

3. An audio looping system comprising:

means for detecting a specific audio event comprising the time of a note or chord played by a performer;

means for identifying a location of the specific audio event in stored audio data, means for designating a beginning of an audio segment of the stored audio data in response to detecting a first occurrence of the specific audio event, means for designating an end of the audio segment in response to detecting another occurrence of the specific audio events and means for repeatedly out putting the audio segment.

4. The system of claim 3, wherein the specific audio event comprises a change in an audio signal.

5. The system of claim 4, wherein the change is a change in time averaged amplitude of the audio signal.

6. The system of claim 4, wherein the change is a change in the fundamental frequency of the audio signal.

7. The system of claim 4, further comprising means for designating a number of occurrences of the specific audio event occurring after the first occurrence of the specific audio event as the length of the audio segment.

8. The system of claim 7, wherein a location of the first occurrence of the specific audio event is identified as the beginning of the audio segment and a location of a last one of the number of occurrences of the specific audio event is identified as the end of the audio segment.

9. The audio looping system of claim 3, wherein the beginning of the audio segment corresponds to a specific reference location of the specific audio event, and the end of the audio segment corresponds to the specific reference location of the another occurrence of the specific audio event.

10. A method performed by a programmable device for applying a loop effect to an audio input signal, the method comprising:

receiving an audio input signal;

identifying an audio segment through user input;

storing the audio segment from a start event location to an end event location, the start event location corresponding to a first location where a specific audio event was detected, and the end event location corresponding to a second location where another occurrence of the specific audio event was detected; and repeatedly outputting the stored audio segment.

11. The method of claim 10 wherein a first user input specifies the start event location of the audio segment to be the next or nearest occurrence of the specific audio event in the audio input signal.

12. The method of claim 11, wherein a second user input specifies the end event location of the audio segment to be the next or nearest another occurrence of the audio event in the audio input signal.

13. The method of claim 12, wherein the audio segment is repeatedly output until a user supplied stop command.

14. The method of claim 10, wherein the start event location corresponds to a specific reference location of the specific audio event, and the end event location corresponds to the specific reference location of the another occurrence of the specific audio event.

* * * * *

UNITED STATES PATENT AND TRADEMARK OFFICE

CERTIFICATE OF CORRECTION

PATENT NO. : 7,592,533 B1
APPLICATION NO. : 11/336730
DATED : September 22, 2009
INVENTOR(S) : Gary Lee It is certified that error appears in the above-identified patent and that said Letters Patent is hereby corrected as shown below:

| | |
|---|---|
| Column 5, Claim 3, line 20 | Delete "," Insert -- ; -- |
| Column 5, Claim 3, line 26 | Delete "events" Insert -- event -- |
| Column 5, Claim 3, line 27 | Delete "out putting" Insert -- outputting -- |
| Column 6, Claim 11, line 23 | Insert -- , -- after number 10 |

Signed and Sealed this

Sixth Day of July, 2010

David J. Kappos

David J. Kappos
*Director of the United States Patent and Trademark Office*